US008234836B2

(12) United States Patent
Anderson

(10) Patent No.: US 8,234,836 B2
(45) Date of Patent: Aug. 7, 2012

(54) METHOD OF MANUFACTURING A METAL FRAMING MEMBER

(75) Inventor: Jeffrey A. Anderson, Belleville, MI (US)

(73) Assignee: Jeffrey A. Anderson, Belleville, MI (US)

( * ) Notice: Subject to any disclaimer, the term of this patent is extended or adjusted under 35 U.S.C. 154(b) by 1181 days.

(21) Appl. No.: 11/182,810

(22) Filed: Jul. 18, 2005

(65) Prior Publication Data

US 2006/0016148 A1 Jan. 26, 2006

Related U.S. Application Data

(63) Continuation-in-part of application No. 10/633,694, filed on Aug. 5, 2003.

(60) Provisional application No. 60/588,798, filed on Jul. 19, 2004.

(51) Int. Cl.
*E04C 3/09* (2006.01)

(52) U.S. Cl. ..... 52/843; 52/635; 52/670; 29/897.31

(58) Field of Classification Search ..... 52/633.1, 52/720.1, 730.1, 730.5, 731.9, 733.2, 661, 52/670, 831, 839, 842, 843, 636, 635, 641, 52/650.1, 651.07, 653.2; 29/6.1, 897.31, 29/897.35

See application file for complete search history.

(56) References Cited

U.S. PATENT DOCUMENTS

| | | | | |
|---|---|---|---|---|
| 2,052,024 | A * | 8/1936 | Hahn | 52/635 |
| 2,703,003 | A | 3/1955 | Ruppel | |
| 3,034,197 | A * | 5/1962 | Watanabe | 29/6.1 |
| 3,094,197 | A | 6/1963 | Attwood | |
| 3,465,406 | A * | 9/1969 | Myers | 29/890.042 |
| 3,477,187 | A | 11/1969 | Fruman | |
| 3,648,426 | A | 3/1972 | Chaudhary | |
| 3,812,558 | A * | 5/1974 | Watanabe | 29/6.1 |
| 4,016,700 | A | 4/1977 | Blomstedt | |
| 4,016,701 | A * | 4/1977 | Beynon | 52/506.07 |
| 4,617,770 | A | 10/1986 | Hickman | |
| 4,619,098 | A | 10/1986 | Taylor | |
| 4,697,393 | A | 10/1987 | Madray | |
| 4,793,113 | A | 12/1988 | Bodnar | |
| 4,811,539 | A | 3/1989 | Menchetti | |
| 4,862,667 | A | 9/1989 | Melland | |
| 5,001,017 | A | 3/1991 | Alhamad et al. | |
| 5,093,971 | A * | 3/1992 | Hein | 29/6.1 |
| 5,095,597 | A | 3/1992 | Alhamad et al. | |
| 5,134,825 | A * | 8/1992 | Berridge | 52/520 |

(Continued)

FOREIGN PATENT DOCUMENTS

| | | |
|---|---|---|
| DE | 3336378 | 2/1985 |

(Continued)

*Primary Examiner* — Jeanette E. Chapman
(74) *Attorney, Agent, or Firm* — Steptoe & Johnson LLP

(57) ABSTRACT

A framing member incorporates a series of web slots along a portion of the member that are expanded through the process of manufacture. The expansion of the web slots creates voids and metal web elements in the webbed portion of the member, which can be a stud. The voids created during the expansion process can become the voids for running wiring, plumbing and heating ducts. The web elements can be designed to minimize thermal transmission from the exterior to the interior of a wall including the member, as well as provide adequate structure properties required from the structural member. The expanded slots allow the part to enlarge without increasing the amount of raw material and therefore substantially reducing the cost to manufacture.

18 Claims, 5 Drawing Sheets

U.S. PATENT DOCUMENTS 5,297,416 A 3/1994 Alhamad et al.
5,402,852 A 4/1995 Alhamad et al.
5,467,566 A * 11/1995 Swartz et al. ..... 52/235
5,527,625 A 6/1996 Bodnar
5,551,135 A * 9/1996 Powers, III ..... 29/6.1
5,575,339 A 11/1996 Alhamad
5,605,024 A 2/1997 Sucato et al.
5,664,380 A 9/1997 Hsueh
5,738,175 A 4/1998 Alhamad
5,778,626 A * 7/1998 Hellsten ..... 52/844
5,816,332 A 10/1998 Alhamad
5,913,788 A 6/1999 Herren
5,927,041 A 7/1999 Sedlmeier et al.
5,950,385 A 9/1999 Herren
6,050,048 A * 4/2000 Hellsten ..... 52/844
6,062,316 A 5/2000 Alhamad
6,089,325 A 7/2000 Alhamad
6,117,062 A 9/2000 Alhamad
6,199,336 B1 3/2001 Poliquin
6,205,740 B1 * 3/2001 Ekerholm et al. ..... 52/846
6,349,774 B2 2/2002 Alhamad
6,381,916 B1 5/2002 Maisch et al.
6,612,090 B1 9/2003 Corden
6,637,159 B1 * 10/2003 Heath ..... 52/2.21
6,699,563 B1 3/2004 Alhamad
6,729,096 B1 5/2004 Ashmore et al.
7,257,932 B2 * 8/2007 Ng ..... 52/634

FOREIGN PATENT DOCUMENTS

GB 1196914 A * 7/1970
GB 0 136 618 4/1985
RU 586246 A * 1/1978

* cited by examiner

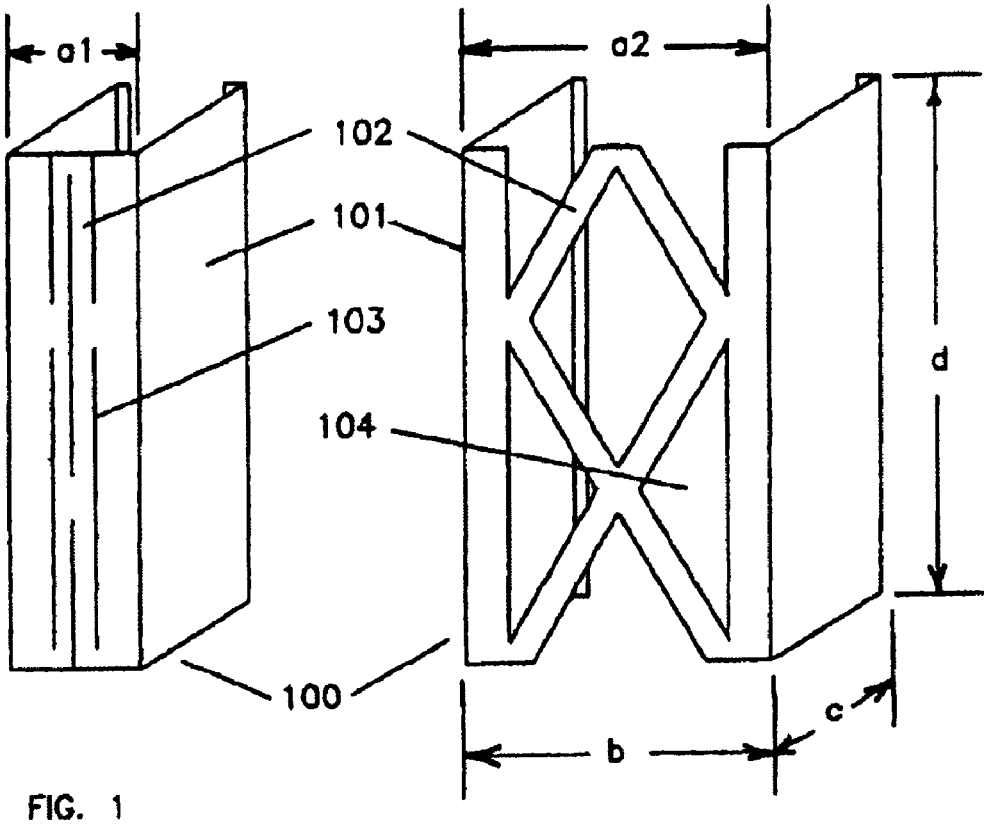
FIG. 1
FIG. 1a
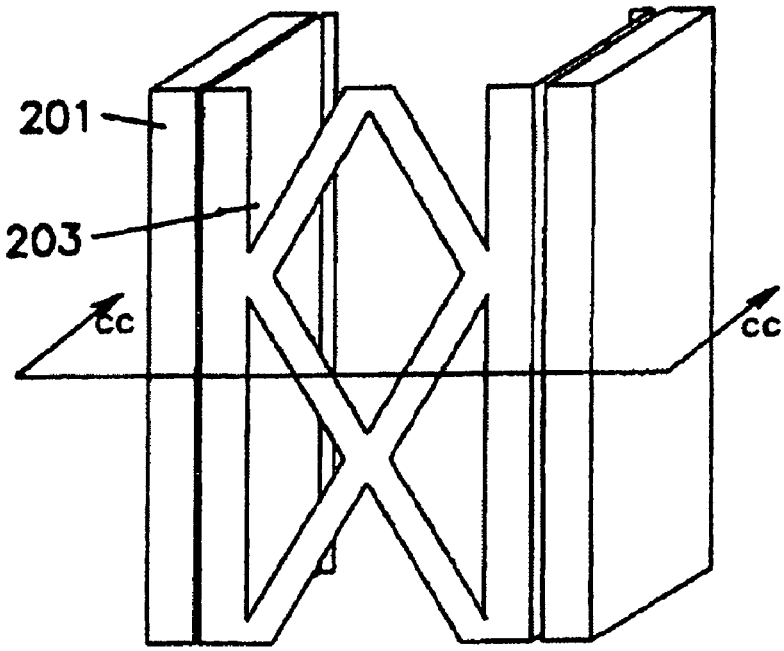
FIG. 2 sect.cc

Sect. aa

Sect. bb

METHOD OF MANUFACTURING A METAL FRAMING MEMBER

CLAIM OF PRIORITY

This application is a continuation-in-part of U.S. patent application Ser. No. 10/633,694, filed on Aug. 5, 2003, and claims priority to U.S. Patent Application Ser. No. 60/588,798, filed on Jul. 19, 2004, each of which are hereby incorporated by reference in their entirety.

TECHNICAL FIELD

This invention relates to building materials, and more particularly to a metal framing member for structural and non-structural building applications.

BACKGROUND

The use of light gauge metal framing members for structural and non structural applications has grown in the residential and light commercial building industry due, in part, to volatile lumber costs and the inconsistent and unpredictable quality of wood studs. Although the use of metal in framing applications has increased over the last few years, a few issues have resulted in the rate of growth being inhibited. Exemplary issued include the relatively high cost of manufacturing the metal members and the high of the thermal conductivity. For example, metal members transmit cold and heat at a rate significantly higher than wood counterparts. While composite materials of wood and metal can help resolve the thermal conductivity issues, increased cost can result.

SUMMARY

A framing member including a series of slots along a portion of the member can be expanded during manufacture. The expansion of the slots creates an expanded region that includes voids and metal web elements in the framing member. The voids created during the expansion process can be used for running wiring, plumbing and heating ducts. The expanded slots can be designed to minimize thermal transmission from the exterior to the interior of the wall of the finished structure and can provide adequate structural properties for the application. The expanded slots can allow the dimensions of the part to enlarge without increasing the amount of raw material, which can substantially reduce the cost to manufacture the member. For example, the expanded slots can create a condition where the cost of raw material to produce the member is reduced by as much as 30 to 50%, for example, 40%, as compared to metal member technology that does not include the expanded slots, such as punching or pressing to form voids.

In one aspect, a metal framing member includes a formed sheet of metal with a series of slots created in a region of the member. The region can be expanded in the manufacturing process to create voids and web elements in the region of the member. The member can exhibit desired dimensional and structural and thermal performance based on customer requirements at a more affordable price. Framing members include both structural and non-structural member designs.

In one aspect, a metal framing member includes a formed metal sheet including a plurality of expanded web slots in a region of the formed sheet metal.

The expanded web slots can include voids and metal web elements in the region of the framing member. The formed metal sheet can include a web region and a first flange extending from the web region. The formed metal sheet can include a second flange extending from the web region in a direction substantially parallel to the first flange. In some embodiments, the formed metal sheet can includes a closing region extending the first flange to the second flange to form a substantially tubular structure. In certain embodiments, one or more of the web region, the closing region, the first flange and the second flange includes the expanded web slots.

In another aspect, a preexpanded metal framing member includes a formed metal sheet having a length and including a web region and two flanges, each flange extending from the web region, and a plurality of web slots extending along a portion of the length in the web region or at least one of the flanges. The flanges can extend from the web region in a direction substantially parallel relationship. The formed metal sheet can include a closing region extending between the flanges. The web region, each flange, the closing region, or combinations thereof, can includes the web slots.

In another aspect, a method of manufacturing a framing member includes providing a formed metal sheet having a length and a web region, and placing a plurality of slots along a portion of the length in the web region. The formed metal sheet can be provided by roll forming a metal sheet. The plurality of slots can be placed by piercing or stamping slots into the region. The method can include expanding the slots of the web region to form expanded slots having a web element and a web void, for example, by passing the formed metal sheet over a tapered block or mechanically moving sides of the region apart. The method can also include reinforcing the expanded formed metal sheet, for example, by placing a flange or dart in the web element. The method can include placing a plurality of slots along the length in each of a first flange and a second flange of the formed metal sheet, which can be expanded. The plurality of slots can be placed by arranging the slots in offset columns substantially parallel to a length of the member. The method can include heat-treating the member after expanding the slots, heat-treating the member prior to expanding the slots, or heat-treating the member while expanding the slots.

In another aspect, a method of building a structure includes placing an expanded framing member in a portion of the structure. The expanded framing structure can include a plurality of expanded web slots forming a plurality of voids in a region of the framing member. The method can include installing wiring, plumbing or a heating duct through at least one void of the member.

Each slot can extend along a portion of a length of the member. For example, the plurality of slots can be arranged in offset columns substantially parallel to a length of the member, to form, e.g., three or more (e.g., 5 or more) columns of slots along the length of the member. The member can include reinforcements in the web elements, which can include flanges or darts.

Advantageously, the expanded framing member provides a design that can reduce the production costs of the of light gauge metal framing members used today in residential and commercial construction by cutting slots in the web area of the metal member and expanding the web-area through a manufacturing process. The expansion creates and openings web elements that connect the flanges of the member without forming voids or holes by cutting and scrapping the material at a substantial cost penalty. Thus, this concept substantially eliminates manufacturing scrap, creating structurally and dimensionally stable members at significantly reduced cost as compared to manufacture of nonexpanded framing members. The structure of the expanded web can be enhanced by creating dimples and flanges at strategic locations during the manufacturing process.

The expanded framing member also can have a design that can reduce the rate of heat transfer through the member by, for example, controlling the quantity, width and length of web elements of the members. For example, a thin and long web element can reduce the rate of heat transfer from one flange to the other resulting in improvement in the overall R-Value of the wall incorporating the expanded framing member. For example, a recent study performed on several alternative designs showed that large voids produced in the web area decrease of the stud can decrease the thermal transfer rate by a much as 50% when compared to a standard available metal stud.

In another advantage, the voids created during expansion in the web area can facilitate the installation of wiring and plumbing through the wall in a manner that tradespersons are accustomed to dealing with. This can be achieved by developing the shape and size of the openings created by the configuration of the web slots and web elements.

The details of one or more embodiments are set forth in the accompanying drawings and the description below. Other features, objects, and advantages will be apparent from the description and drawings, and from the claims.

DESCRIPTION OF DRAWINGS

FIG. 1 is a perspective view of a portion of the member with forming complete and web created but prior to expansion into final configuration.

FIG. 1*a* is a perspective view of the member of FIG. 1 with forming complete, web slots created and expanded into its expanded configuration.

FIG. 2 is a perspective view of a portion of a member with insulation strips shown attached to the flanges.

DETAILED DESCRIPTION

Figure 2A:
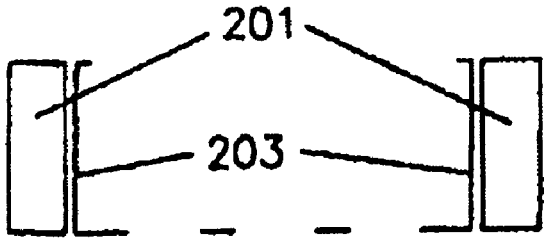
FIG. 2*a* is a section view of the member of FIG. 2 with insulation strips shown attached to the flanges.

A framing member can be manufactured by expanding metal in a web region, a flange region, or both, during the manufacturing process. Slots can be formed in a pattern such that the region can be expanded during the manufacturing process. The expansion creates the voids and web elements that extend at least one dimension of the framing member. The voids can create thermal resistance which reduces the thermal conductivity of the member and improves R-value of the ultimate structure. Because the metal is expanded, there is little or no scrap metal produced during manufacture.

FIG. 1 is an isometric view of a portion a framing member 100 prior to expansion into the final configuration but with the web slots 103 pierced into the web area. The placement, shape and length of the web slots 103 in a region having dimension a1 determine the width and length of the web elements 102 as well as the shape and size of the web voids. Flanges 101 extend away from the web region. The member can be manufactured in part or in whole through a roll forming process. Alternatively, a stamping process can be used to manufacture the member. The member can be manufactured from steel or aluminum, or any other suitable metal in sheet form. The sheet can have a thickness of, for example, 24 to 10 gauge.

Referring to FIG. 1*a*, which depicts an expanded framing member, the typical dimension c of flange 101 can be approximately 1.5 inches, although it can be adjusted for different applications. Web area dimension a1 in the region increases during the manufacturing process by expanding the slots to become significantly wider until the web area reaches the final dimension a2 is shown on FIG. 1*a*. The final quantity, shape and width and length of the web slots determine the size of web voids 104 and web elements 102 are selected to optimize all of the objectives and limitations of the material to be formed into the final shape. Optimization will depend upon specific customer needs. Dimension b can be 2.5 inches to 11.5 inches but can be higher if required. The final member length d can be 92 to 120 inches for wall studs and 2 feet to 20 feet for structural elements such as floor joists, although, generally, dimension d can be any length.

The framing member can be manufactured by a process, for example, that includes passing a sheet of metal from a coil through a series of form rolls that create the structural shape of the framing member. During the roll forming process, the web slots are pierced into the region to be expanded, such as center web area b. The piercing can be performed with a stamping die, a configured roll, laser or any other suitable method of creating the web slot. The web slot configuration can be adjusted to accommodate any desired shape or length in order to create a web void or web element that enhances the thermal performance, cost reduction, tradesperson access, structural enhancement or any other desired objective not currently realized.

After the web slots have been incorporated into the region of the member, the member can be expanded by moving the flanges perpendicularly opposed to one another until the desired width a2 is obtained. The expansion process can be performed in several ways including passing the member over a tapered forming block during the roll forming process. For example, the unexpanded member can be forced over a tapered forming block that fits between the two flanges. As the flanges move down forming line and over the tapered forming block, the flanges move progressively apart until reaching the desired width a2 shown in FIG. 1*a*. An alternative to a tapered forming block can be rolls or a block including rolls attached to the forming block. An alternative method of expansion by rolling can include expanding using a mechanical or hydraulic mechanism that locks onto the flanges on the member and move them apart to the desired width a2. The expansion can extend a dimension by a factor of 10% to 300%, 20% to 250%, or 50% to 100%.

The final width determines the overall width of the member as well as the final configuration and dimension of the of the web voids. After expanding, the member can be heat treated to strengthen a portion of the member, for example, by heating the portion of the member for a period of time, or the entire member, and quenching the member. The member can have a yield strength of between 10 and 100 ksi, or 30 to 60 ksi, for example, 33 ksi or 50 ksi.

An alternative method of manufacturing the expanded web is to apply heat to change the mechanical properties of the metal prior to or during expansion. The heat can be used in to anneal the material according to acceptable practices. This can be accomplished by heating and cooling to remove residual stress and work hardening that has taken place during the rolling process of steel manufacture. Annealing can maximize the ability to cold form and expand the web. In another example, the heat can be applied to heat the material to a temperature that can allow the web to be formed, or expanded, while in the elevated temperature state. After forming, the material can be cooled in whatever method or at whatever speed is desired to obtain the final desired mechanical properties. The second process allows the ability to create a higher strength steel product and significantly improve the mechanical properties of the stud if desired. In each method, the heat can be applied locally or globally to the material as desired.

Referring to FIGS. 2 and 2*a* an insulated strip 201 can be attached to the flange 203 by adhesive, staples, nails or other similar fasteners. The insulated strip can be made of wood, plastic, or other materials that can function as both a thermal insulated barrier fire resistant and exhibit characteristics that would allow conventional nailing. This can allow the use of nail guns and other automated tools normally used for attaching the structural members together and sheathing to flanges. This configuration can have insulated strips on either one or both flanges of the member.

Figure 3:
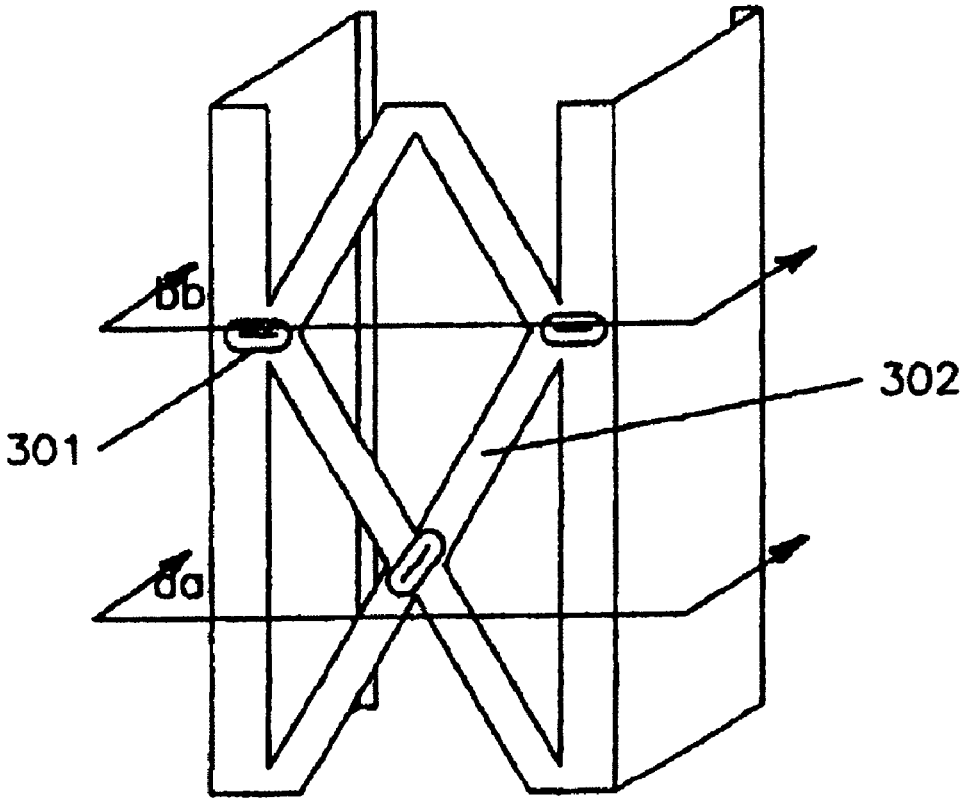
FIG. 3 is a perspective view of a portion of a member with darts and flanges shown in locations of the member.
Figure 3A:
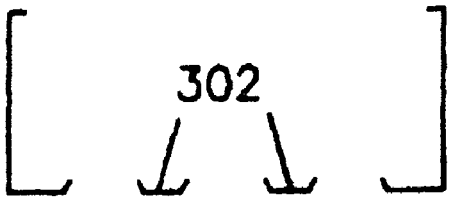
FIG. 3*a* is a section view of the member of FIG. 3 through a darted area showing a typical configuration.
Figure 3B:
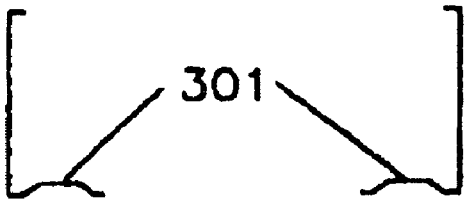
FIG. 3*b* is a section view of the member of FIG. 3 through a flanged area showing a typical configuration.
Figure 4A:
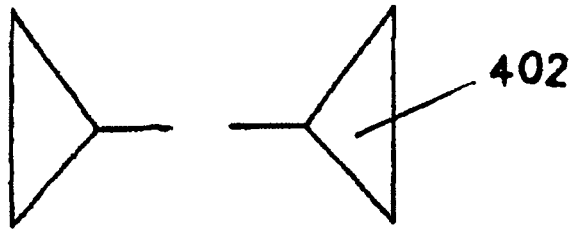
FIG. 4*a*-4*e* are section views showing alternative flange configurations that could be used in conjunction with the expanded web.
Figure 4B:
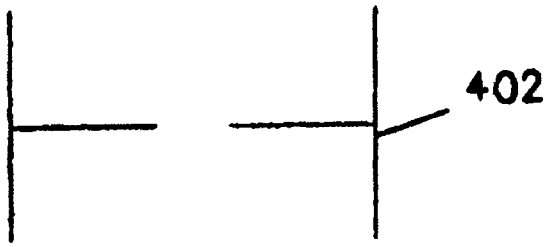
Figure 4C:
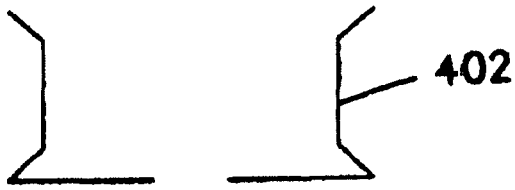
Figure 4D:
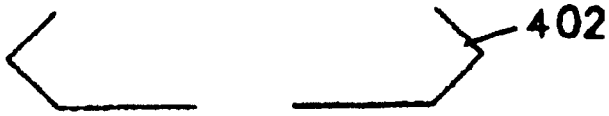
Figure 4E:
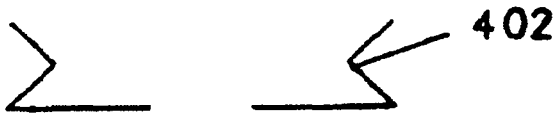

FIG. 3 is perspective showing an expanded web framing member made with optional flanges 302 and darts or dimples 301 that can enhance the structural properties of the web elements, and the member. The expanded slots form regions of stress in the member, which can enhance or degrade the structural properties of the member. The darts or dimples, or flanges, can reduce stress in the member introduced during expanding, thereby strengthening the member. The flanges and darts can be incorporated, for example, during the roll forming operation of manufacture, or by stamping or rolling in to the sheet prior, to or after the shaping operation. The shape and configuration of the darts and flanges can be adjusted to any length, shape or depth in order to achieve the desired objectives. FIG. 3*a* shows a cross section of the member of FIG. 3 through the flanged area of the web element and depicts flanges 302. FIG. 3*b* shows a cross section of the members of FIG. 3 through the dimpled or darted area 301.

FIG. 4*a*-4*e* show a cross section of various members with alternative flange configurations 402 that can be applied to the expanded framing member. The effectiveness and benefits of the expanded web design can be enhanced by the different configurations of the flanges, however, any alternative flange configuration can generally be used.

Figure 5:
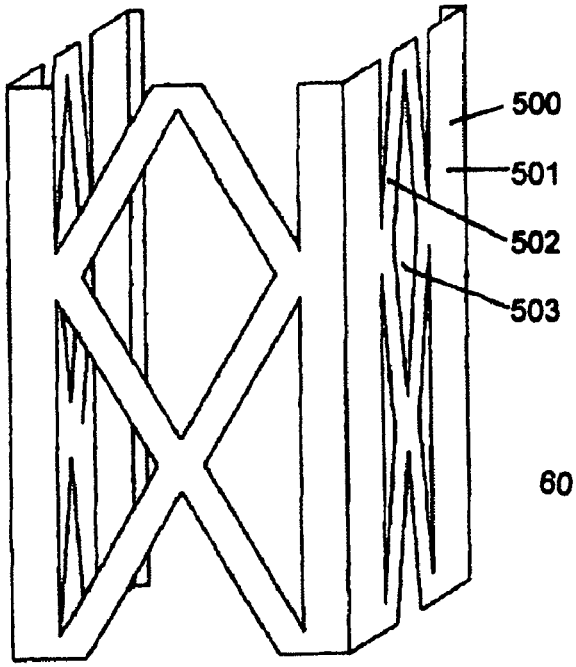
FIG. 5 is a perspective of a portion of a member with expanded web in the flange area.

FIG. 5 is a perspective of a framing member 500 that includes web slots 503 and web elements 502 within the flange 501 of the member.

Figure 6:
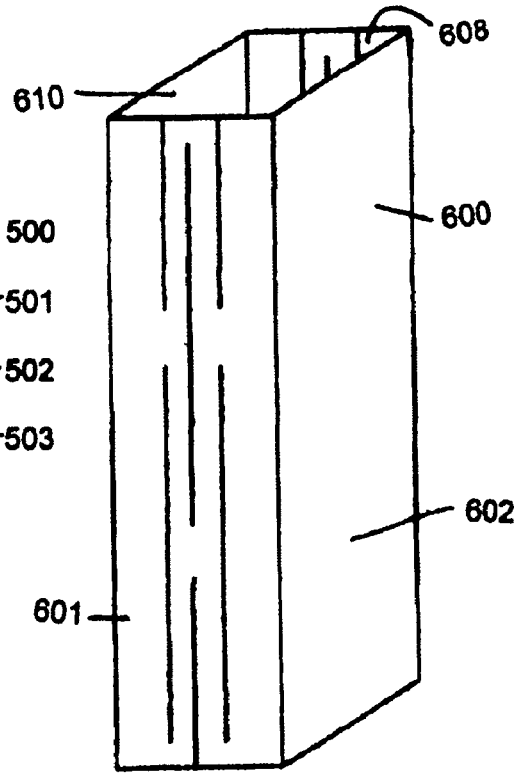
FIG. 6 is a perspective view of a portion of the member in a tubular configuration with forming complete, web slots created but prior to expansion.
Figure 6A:
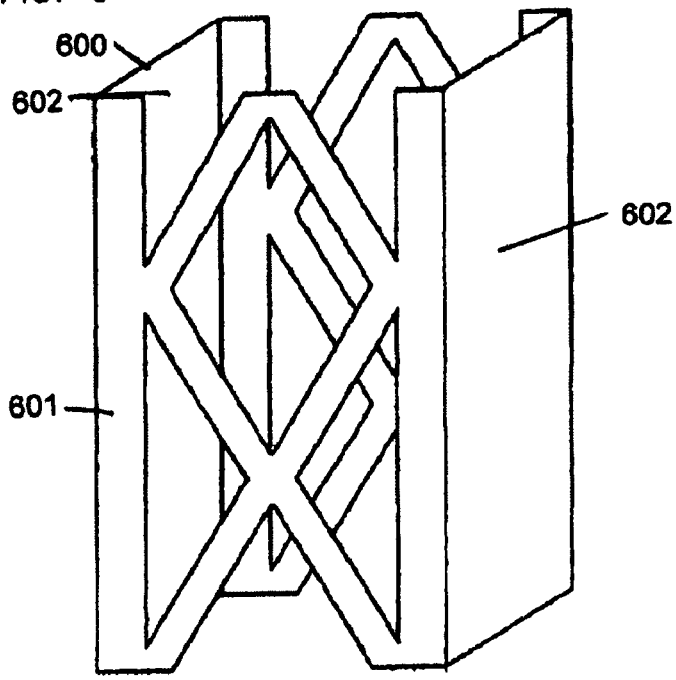
FIG. 6*a* is a perspective of the member of FIG. 6 with forming complete, web slots created and expanded.

FIG. 6 and FIG. 6*a* depict an alternative framing member 600 made of a tubular section 610 having web region 601, flanges 602, and closing region 608. FIG. 6 is the member 600 shown prior to expansion and FIG. 6*a* is the member 600 shown in the final expanded form. The tubular section can exhibit improved torsional rigidity as compared to an open "C" section (see, for example, the member of FIG. 1). The improved torsional rigidity can be desirable in some structural applications.

Figure 7:
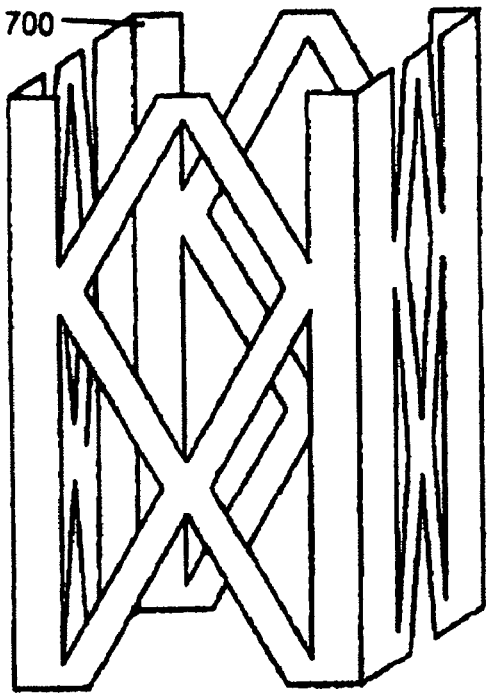
FIG. 7 is a perspective of a portion of a tubular section with expanded web design on both the web area and flange area.

FIG. 7 is a perspective of another member 700 similar to the one shown in FIG. 6*a*, which includes web slots and web elements within the flange of the member.

Figure 8:
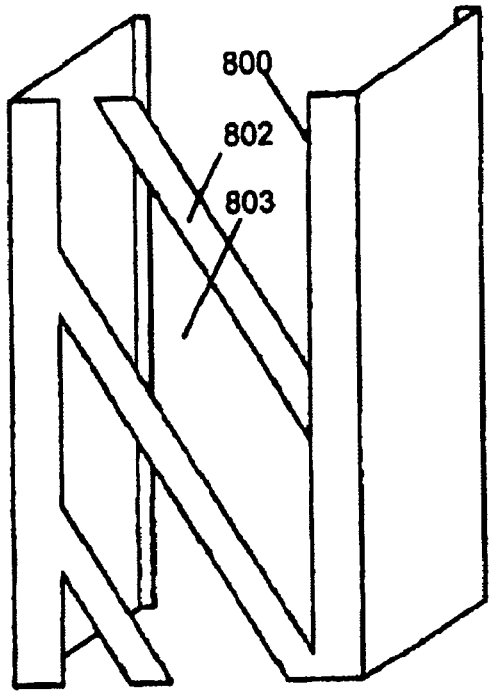
FIG. 8 is a perspective of a portion of a member with an alternative web slot and web element configuration.
Figure 9:
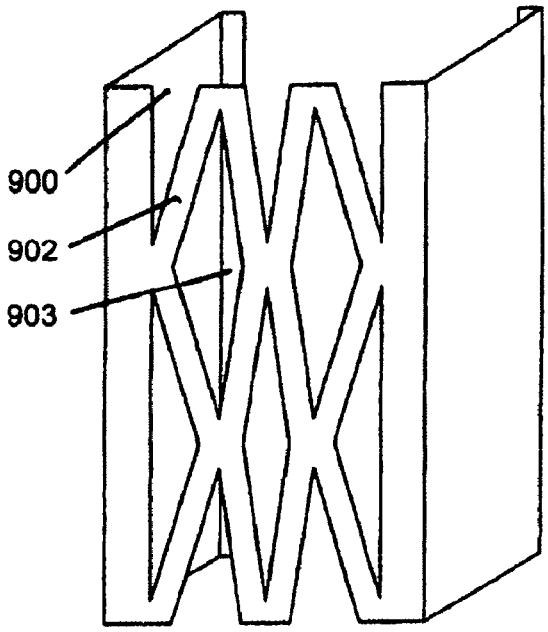
FIG. 9 is a perspective of a portion of a member with an alternative web slot and web element configuration.

FIGS. 8 and 9 depict perspective views of members 800 and 900, respectively, that include varied web element 802 and 902 and web void 902 and 903 configurations. It is important to state that the configuration of the web slots and web elements are determined on a case-by-case basis. These alternatives shown are only examples and are not meant to be limiting.

A number of embodiments have been described. Nevertheless, it will be understood that various modifications may be made without departing from the spirit and scope of the concepts described above. For example, the expanded framing member concept can apply to other structural members such as floor joists, in which the web slots can be designed to create web elements capable of withstanding a structural load. If required, the web slot and web elements can have darts and flanges added to create strength. Accordingly, other embodiments are within the scope of the following claims.

What is claimed is:

1. A method of manufacturing a framing member comprising:

providing a formed metal sheet, the formed metal sheet being a single unitary tubular member having a length, a web region and a closing region;

placing a plurality of slots along a portion of the length in the web region and the closing region;

expanding the slots of the web region and the closing region to form expanded slots having a web element and a web void, the metal sheet being heat treated; and forming the single unitary tubular member from a single sheet of metal.

2. The method of claim 1, wherein providing the formed metal sheet includes roll forming a metal sheet.

3. The method of claim 1, wherein placing the plurality of slots includes piercing slots into the region.

4. The method of claim 1, wherein placing the plurality of slots includes stamping the slots into the region.

5. The method of claim 1, wherein expanding the slots includes passing the formed metal sheet over a tapered block.

6. The method of claim 1, wherein expanding the slots includes mechanically moving sides of the region apart.

7. The method of claim 1, further comprising reinforcing the expanded formed metal sheet.

8. The method of claim 7, wherein reinforcing includes placing a flange or dart in the web element.

9. The method of claim 1, wherein the formed metal sheet includes a first flange extending from the web region and a second flange extending from the web region in a direction substantially parallel to the first flange.

10. The method of claim 9, further comprising placing a plurality of slots along a portion of the length in each of the first flange and the second flange.

11. The method of claim 10, further comprising expanding the slots of the first flange and the second flange.

12. The method of claim 9, wherein the formed metal sheet further includes a closing region extending the first flange to the second flange to form a substantially tubular structure.

13. The method of claim 1, wherein placing the plurality of slots includes arranging the slots in offset columns substantially parallel to a length of the member.

14. The method of claim 1, further comprising heat treating the member after expanding the slots.

15. The method of claim 1, further comprising heat-treating the member prior to expanding the slots.

16. The method of claim 1, further comprising heat-treating the member while expanding the slots.

17. The method of claim 1, further comprising annealing the member.

18. The method of claim 1, wherein the closing region is opposite the web region.

* * * * *